US005226538A

United States Patent [19]

Roselle

[11] Patent Number: 5,226,538

[45] Date of Patent: Jul. 13, 1993

[54] FILLED PACKAGE EXHIBITING A SUBSTANTIALLY COLORLESS TRANSPARENT APPEARANCE

[75] Inventor: Brian J. Roselle, Fairfield, Ohio

[73] Assignee: The Procter & Gamble Company, Cincinnati, Ohio

[21] Appl. No.: 922,122

[22] Filed: Jul. 29, 1992

[51] Int. Cl.[5] ..... B65D 73/00

[52] U.S. Cl. ..... 206/459.1; 206/457; 215/1 C; 428/36.92; 252/90

[58] Field of Search ..... 206/457, 459.1; 215/1 C; 428/36.92; 252/90; 73/426, 427

[56] References Cited

U.S. PATENT DOCUMENTS

| | | | |
|---|---|---|---|
| 2,452,385 | 10/1948 | Merckel | 23/253 |
| 2,622,598 | 12/1952 | Rosenblum | 128/272 |
| 2,810,978 | 10/1957 | Chapman | 41/22 |
| 3,533,548 | 10/1970 | Taterka | 206/459.1 |
| 4,053,666 | 10/1977 | Taylor et al. | 428/35 |
| 4,139,517 | 2/1979 | Zaganiacz | 260/37 |
| 4,285,105 | 8/1981 | Kirkpatrick | 206/459.1 |
| 4,482,586 | 11/1984 | Smith et al. | 428/35 |
| 4,658,974 | 4/1987 | Fujita et al. | 215/12 R |
| 4,829,641 | 5/1989 | Williams | 24/587 |
| 4,905,395 | 3/1990 | Stoesser et al. | 206/459.1 |
| 4,919,983 | 4/1990 | Fremin | 428/35.7 |
| 4,990,382 | 2/1991 | Weissenstein et al. | 428/35.7 |
| 5,089,309 | 2/1992 | Odate et al. | 428/36.92 |

FOREIGN PATENT DOCUMENTS

| | | |
|---|---|---|
| 0042930 | 6/1980 | European Pat. Off. . |
| 2742756 | 9/1977 | Fed. Rep. of Germany . |
| 5920550 | 7/1978 | Japan . |
| 5768338 | 10/1980 | Japan . |
| 6239443 | 8/1985 | Japan . |

*Primary Examiner*—David T. Fidei

*Attorney, Agent, or Firm*—Kevin C. Johnson; E. Kelly Linman; R. L. Hemingway

[57] ABSTRACT

The present invention provides a filled package which exhibits a substantially colorless transparent appearance. The package is made of a substantially transparent container which exhibits the tint of a first color. A substantially transparent liquid which exhibits the tint of a second color which is different than the first color is housed in the container. The tint of the first color of the container and the tint of the second color of the liquid cooperate with one another such that the tinted container exhibits a substantially colorless transparent appearance when filled with the tinted liquid.

13 Claims, 2 Drawing Sheets

FILLED PACKAGE EXHIBITING A SUBSTANTIALLY COLORLESS TRANSPARENT APPEARANCE

FIELD OF THE INVENTION

The present invention relates to a substantially transparent, tinted container being filled with a substantially transparent, tinted liquid, and more particularly, to such a substantially transparent, tinted container that when filled with a substantially transparent, tinted liquid exhibits a substantially colorless transparent appearance.

BACKGROUND OF THE INVENTION

Many liquid products, such as liquid soaps, exhibit a color that is not particularly pleasing to the consumer, e.g., a milky white or yellow color. In order to provide a liquid soap that is visually pleasing to the consumer manufacturers often alter the appearance of the liquid soap or the container or both.

Liquid soaps exhibiting colors not particularly pleasing to the consumer are often packaged in tinted, opaque plastic container. The tinted, opaque plastic container provides a visually pleasing appearance to the consumer by covering or masking the not so pleasing liquid soap.

Other liquid soap products are packaged in transparent, plastic containers. The liquid soap is heavily tinted so that the filled packaged exhibits the tint of the liquid soap. The heavily tinted liquid soap housed within the transparent, plastic container provides a visually pleasing appearance to the consumer.

Another packaging alternative for liquid soap products is to provide a filled package that exhibits a colorless, transparent appearance. A colorless, transparent package provides a particularly pleasing appearance to the consumer. However, because liquid soaps often exhibit a yellowish appearance the liquid soap must be bleached or bleached and aged over an extended period of time to remove the unpleasing yellowish appearance prior to placing the liquid soap in a transparent, colorless container. Bleaching and aging of the liquid soap increases the cost of handling and storage which results in an overall increased cost to the consumer.

Accordingly, it is an object of the present invention to provide a fulfilled package that exhibits a substantially colorless, transparent appearance.

It is further an object of the present invention to provide a filled package that exhibits a substantially colorless, transparent appearance without subjecting the tinted liquid to be placed within the package to extensive processing or aging.

It is further an object of the present invention to provide a filled package that exhibits a substantially colorless, transparent appearance at minimal costs.

SUMMARY OF THE INVENTION

The present invention provides a filled package that exhibits a substantially colorless, transparent appearance. In a preferred embodiment, a substantially transparent container exhibits the tint of a first color and is adapted to house a liquid. A substantially transparent liquid which exhibits the tint of a second color, that is different than that of the first color of the container, is housed in the container. The tint of the first color of the container and the tint of the second color of the liquid cooperate with one another such that the tinted container, when filled with the tinted liquid, exhibits a substantially colorless transparent appearance.

The container preferentially absorbs wavelengths in the range from about 530 nm to about 630 nm. The liquid preferentially absorbs wavelengths in the range from about 430 nm to about 530 nm. Preferably, the filled package absorbs wavelengths in the range from about 470 to about 610 substantially uniformly.

BRIEF DESCRIPTION OF THE DRAWINGS

While the specification concludes with claims particularly pointing out and distinctly claiming the present invention, it is believed that the present invention will be better understood from the following description in conjunction with the accompanying drawings, in which like reference numbers identify identical elements and wherein:

DETAILED DESCRIPTION OF THE PRESENT INVENTION

While the present invention will be described in the context of providing a substantially transparent plastic container exhibiting the tint of a first color being filled with a substantially transparent liquid soap exhibiting the tint of second color such that the filled package exhibits a substantially colorless transparent appearance, the present invention is in no way limited to such application. The detailed description contained herein, which relates to a particularly preferred substantially transparent, blue tinted, plastic container being filled with a substantially transparent, yellow tinted liquid soap, and exhibiting a substantially colorless, transparent appearance, will allow one skilled in the art to readily adapt the invention to other uses.

Figure 1:
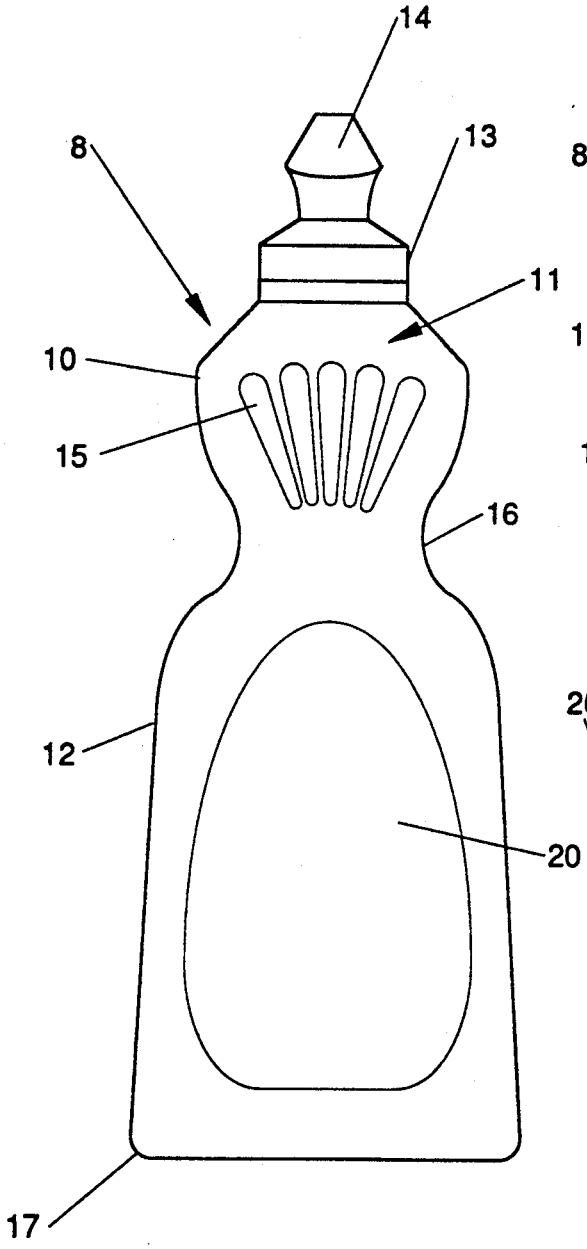
FIG. 1 is a front elevational view of the filled package of the present invention.

FIG. 1 is a front elevational view of a particularly preferred embodiment of a filled package 8 of the present invention. The filled package 8 includes a substantially transparent, tinted container or bottle 10 which houses a substantially transparent, tinted liquid 11. Preferably, the liquid 11 to be housed within the container 10 is a liquid soap. An example of a liquid soap 11 is disclosed in commonly assigned U.S. Pat. No. 4,904,359 issued to Pancheri et al. on Feb. 27, 1990, which is hereby incorporated herein by reference. Pancheri et al. discloses a high sudsing liquid detergent composition containing by weight:

(a) from about 5% to about 50% anionic surfactant;

(b) from about 0.1% to about 12% of polymeric surfactant having the formula selected from the group consisting of $A_nBA_m$, $B_nAB_m$, BA, B and mixtures thereof wherein each B is a hydrophobic group; each A is a hydrophilic group; each n and m are either 0 or an integer from one to about 50; the sum of n+m is from one to about 50; the molecule contains from about 5 to about 1,000 either linkages; when the formula is BA, B contains from about 5 to 500 ether linkages; when the formula is B, the ratio of $—CH_2—$ groups to ether linkages is at least about 2.1:1 and less than about 3:1; the molecular weight is from about 400 to about 60,000; and the percentage of $—C_2H_4O—$ groups in the molecule is less than about 90%;

(c) from 0% to about 10% of a suds stabilizing nonionic surfactant selected from the group consisting of fatty acid amides, trialkyl amine oxides and mixtures thereof;

(d) from 0% to about 10% of a detergency builder selected from inorganic phosphates, inorganic polyphosphates, inorganic silicates, and inorganic corbonates, organic corboxylates, organic phosphonates, and mixtures thereof;

(e) from 0% to about 15% alkanol containing from one to about six carbon atoms; and (f) from about 20% to about 90% water, said composition containing sufficient magnesium ions to neutralize at least about 10% of said anionic surfactant when less than about 10% of the anionic surfactant is an alkylpolyethoxylate sulfate surfactant containing from about ½ to about ten ethoxy groups per molecule on the average (or there is no betaine surfactant present); said composition having a pH of greater than about six when the composition contains said alkylpolyethoxylate sulfate surfactant; said composition having a viscosity of greater than about 100 cps or being substantially free of alkylpolyethoxylate detergent surfactants when the amount of anionic surfactant is less then about 20% (and there is no betaine surfactant present).

The high sudsing detergent composition according to Pancheri et al. containing at least 15% anionic surfactant will exhibit a slight yellow or yellow/green color. The slight yellow or yellow/green color of the liquid soap appears dingy or dirty, especially if the liquid soap were to be placed within a colorless transparent container. One solution to the problem would be to place the liquid snap in a tinted opaque container to cover the dingy yellow liquid soap. Another solution would be to add bleach to the liquid soap composition or bleach and age the liquid soap to remove the yellow color from the liquid soap. Preferably, the container 10 in which the liquid soap 11 is housed is constructed such that the tint or color of the container 10 cooperates with the tint or color of the liquid soap 11 that when the container 10 is filled with the liquid soap 11 the filled container 10 exhibits a substantially colorless transparent appearance.

The container 10 is preferably made of a synthetic resin, such as polyethylene teterphthalate (PET). The container 10 may also be made of other resins such as a glycol modified pet copolymer (PETG), extrudable polyethylene terephthalate (EPET), polyvinyl chloride, (PVC), oriented polypropylene, polycarbonate, polystyrene, high density polyethylene, or any other suitable synthetic resins which exhibit a substantially transparent appearance. The container 10 has a generally oval shaped body 12 and a cylindrical bottle head 13. It will be obvious to those of ordinary skill in the art that body 12 may be any shape, e.g. cylindrical, round, square, oblong, etc. The bottle head 13 has a push-pull dispenser 14 at its uppermost or distal end which permits dispensing of the liquid product 11 is a controlled manner. The manner portion of the container 10 has faceted ridges or angles 15 which enhance the visual appearance of the container 10.

The container 10 preferably has a grip portion 16 which has a smaller circumference than that of base portion 17. Grip portion 16 with its relatively smaller circumference provides a convenient portion for gripping the container 10 by the consumer during use.

Figure 2:
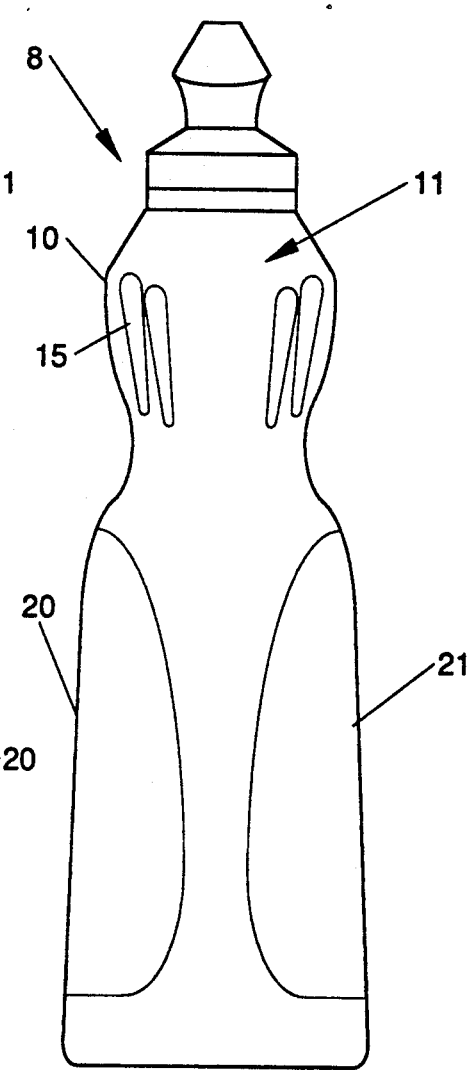
FIG. 2 is a side elevational view of the filled package of the present invention.

As can be seen in FIG. 2, two labels 20 and 21 are adhered to the outer periphery of the container body 12. In this disclosure the word "obverse surface" will mean the label surface exposed to the outside on which the insignia or instructions are to be printed. Similarly, the words "reverse surface" or "inside" mean the surface of the label facing the outer periphery of the container body 12. The front label 20, in a preferred embodiment, will be a colorless, transparent material, e.g. plastic, having the appropriate insignia or instructions printed thereon. The colorless front label 20 facilitates in highlighting and reinforcing the colorless, transparent appearance of this invention, as described herein.

The back label 21 is preferably a white paper stock having printing on both sides thereof. Printed on the reverse surface of the paper stock is a substantially continuous uniform color, that can gradually lighten as it nears the labels outer edges. This serves as a pleasing background which highlights the printing on the clear front label 20 when the container 10 is viewed from the front. So as not to defeat the purpose of the tinting of the container 10, the color of back label 21 should be consistent with, i.e., relatively near is the color spectrum, to the color of the container 10, which will be described in detail below. Preferably, a portion all of the back label 21 will exhibit a light blue color.

To make the substantially transparent, tinted container 10 of the present invention, a tinted preform is first formed on a conventional injection mold. Flakes or pelletized PET resin is fed from a hopper into an extruder where the PET resin is heated to fluidize the resin. An exemplary PET resin is available from Eastman Chemical Company, Kingsport, Tenn., under the designation 9921W. The extruder consists of a reciprocating screw inside a barrel with a standard 25:1 L/D ratio and hydraulic radial piston drive. The reciprocating screw feeds the PET resin through the heated barrel where the PET resin is melted and plasticized to the proper consistency for injection molding of the preform. Tint or colorant is added to the plasticized resin at a point in the barrel where the resin is sufficiently fluid and the reciprocating screw can mix and homogenize the resin with the colorant. An exemplary colorant is a violet blue pigment available from Pigment Dispersions Incorporated, located in Edison, N.J. under the designation No. 99-31016. The tint can be added to the plasticized resin at levels from about 0.18 to about 0.21 parts per 100 of plastic. Preferably, the tint is added to the plasticized resin at a level of about 0.195 parts per 100 of plastic. At the end of the barrel the colored/plasticized resin is fed into a shooting pot in preparation for injection molding. The shooting pot is filled through a shuttle valve; high pressure hydraulic oil then drives the shooting pot piston forward filling the mold. This allows the extruder to continuously plasticize throughout the cycle, and results in higher throughput with a more homogeneous melt. The mold can be a multi cavity mold creating as many as 48 tinted performs at a time. The finished tint performs can be stored and subsequently blown into substantially transparent, tinted containers in the standard fashion. After being blown, the substantially transparent, tinted containers can then be filled with a substantially transparent, tinted liquid soap and sealed.

The tinting of the container 10 should be of such an amount or degree to cooperate with the amount of tint in the liquid soap 11 such that the filled container exhibits a substantially colorless transparent appearance. The necessary amount of tinting for the container 10 will be determined by the amount of tint that the liquid soap 11 exhibits. As the amount of tint in the liquid soap 11 increases, the amount of tint added to the container 10 is increased. Similarly, as the amount of tint in the liquid soap 11 decreases, the amount of tint added to the container 10 is decreased. However, it will be appreciated that, if the amount of tinting of the container is insufficient the filled container will tend to exhibit the tint of the liquid soap, i.e., a yellowish appearance. On the other hand, if the amount of tinting of the container is to great the filled container will tend to exhibit the tint of the container, i.e., a bluish appearance.

The human eyes perceive electromagnetic radiations over a range of wavelengths from about 400 nanometers(nm) to about 700 nm, called the spectrum of visible light. Within the visible spectrum, different wavelengths create the sensation of color. If an object preferentially absorbs certain wavelengths it will give the sensation of a certain color. For example, if an object preferentially absorbs wavelengths in the range from about 430 nm to about 530 nm, violet and blue wavelengths, the object will appear yellow or yellow/green to the human eye. If an object absorbs wavelengths substantially uniformly at relatively low levels of absorption the object will appear clear or colorless to the human eye.

As mentioned above, a liquid soap generally in accordance with the teachings of Pancheri et al. will appear yellow or yellow/green to the human eye. This is due to the fact that the liquid soap preferentially absorbs wavelengths in the range from about 430 nm to about 530 nm. In order to make a filled package containing the yellow or yellow/green liquid soap appear clear or colorless, the container must be of a cooperating tint that will preferentially absorb wavelengths in the range from about 530 nm to about 630 nm, yellow and green wavelengths. By preferentially absorbing the yellow and green wavelengths the bluish container 10 will provide a substantially clear or colorless transparent appearance when filled with the yellowish liquid soap. This is due to the fact that the filled container will absorb wavelengths substantially uniformly and not preferentially as do the liquid soap or container individually.

The present invention may also be practiced by providing a container of a specific tint which will preferentially absorb certain wavelengths to cooperate with the liquid which preferentially absorbs certain wavelengths such that the filled container will absorb wavelengths substantially uniformly and thus exhibit a substantially clear or colorless transparent appearance.

The following example illustrates the present invention.

EXAMPLE 1

A filled package is made according to the following description.

A liquid soap composition containing about 6% magnesium $C_{12-13}$ alkyl sulfate, about 19% mixed magnesium and ammonium $C_{12-13}$ alkyl polyethylate (1) sulfate, about 2.8% $C_{12-13}$ alkyl dimethyl amine oxide, about 4% ethyl alcohol, about 2% ammonium xylene sulfonate, about 60% water, and the balance being inorganic salts, minor ingredients, etc. is prepared.

A tinted preform is formed on a Husky hydraulic two-stage injection unit mold available from Husky International Manufacturing, Bolton, Ontario, Canada. PET resin pellets available from Eastman Chemical Company, Kingsport, Tenn., under the designation 9921W are fed from a hopper into an extruder where the PET resin is heated to fluidize the resin. The extruder consists of a reciprocating screw inside a barrel with a standard 25:1 L/D ratio and hydraulic radial piston drive. The reciprocating screw feeds the PET resin through the heated barrel where the PET resin is melted and plasticized to the proper consistency for injection molding of the preform. A violet-blue pigment available from Pigment Dispersions, Inc., located in Edison, N.J., under the designation of No. 99-31016 is added to the plasticized resin at a level of about 0.195 parts per 100 of plastic at a point in the barrel where the resin is sufficiently fluid and the reciprocating screw can mix and harmoginize the resin with the colorant. At the end of the barrel the color/plasticized resin is fed into a shooting pot in preparation for injection molding. The shooting jet is filled through a shuttle valve; high-pressure hydraulic oil then drives the shooting pot piston forward filling the mold. The finished tinted preform is then blown into a substantially transparent tinted container awaiting to be filled with the substantially transparent tinted liquid soap.

Absorbency measurements were then taken on the various components of the above example using a Hewlett-Packard 8451 Diode array Spectrophotometer. The Hewlett-Packard 8451 Diode array Spectrophotometer is a single beam, microcomputer controlled general purpose UV-visible spectrophotometer. Samples are poured into a disposable plastic cuvett that is 1 $cm^2$ in cross section and about 4.5 cm high. The sample is then placed in the instrument and secured by a retaining clip. The measurement is then taken by shooting the desired radiation through the sample and comparing the known amount of incident radiation to the amount of radiation passed through the sample. In the case where a liquid sample is measured with plastic, a plastic sample approximately 1 cm wide by 4.5 cm high by 0.05 cm thick is placed next to the face of the sample cuvett and held firm against the cuvett by the retaining clip. The incident radiation then passes through the liquid and the plastic strip simulating light passing through the liquid soap and a container wall.

Figure 3:
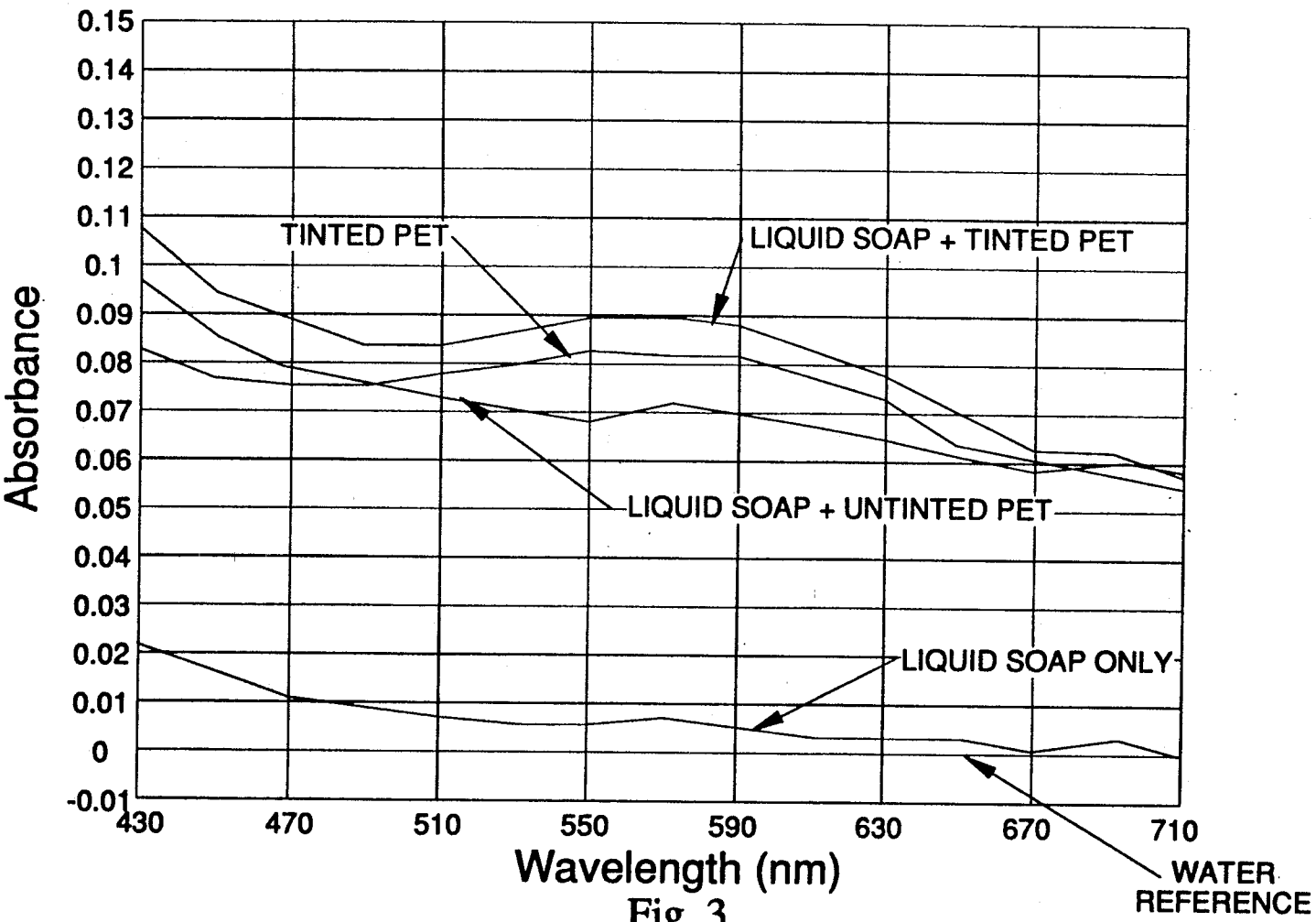
FIG. 3 is a graph of the absorbance of light of various samples at different wavelengths in the visible spectrum.

FIG. 3 is a graph of the absorbance of light of the various components of the above example at different wavelengths in the visible light spectrum. To standardize the spectrophotometer a sample of pure deionized water is measured for absorbance. The rest of the samples are measured for absorbance relative to the deionized water. As can be seen from the plot of the absorbency of deionized water shown in FIG. 3, the colorless deionized water reference reading does not preferentially absorb any specific wavelength within the visible spectrum. The deionized water sample serves as a clear or colorless reference in which differences in absorbance on test samples can be analyzed for color changes by differences in absorption.

A sample of liquid soap was poured in the standard 1 $cm^2$ cuvett and an absorbency measurement was taken on the Hewlett-Packard spectrophotometer. As can be seen from the plot of the liquid soap in FIG. 3, wavelengths in the range from about 430 nm to about 530 nm, violet and blue wavelengths, were preferentially absorbed by the liquid soap. By preferentially absorbing wavelengths in the range from about 430 nm to about 530 nm, violet and blue wavelengths, the liquid soap exhibits a yellow or yellow/green appearance. As mentioned earlier herein, the yellow or yellow/green appearance is not particularly pleasing to the consumer.

An absorbency measurement on the Hewlett-Packard spectrophotometer was taken on a sample of the liquid soap and an untinted PET plastic. As can be seen from the plot of the liquid soap and untinted PET in FIG. 3, the liquid soap and untinted PET sample preferentially absorbed wavelengths in the range from about 430 nm to 530 nm, violet and blue wavelengths. The plot of the absorbance of the liquid soap and untinted PET has a substantially uniform increased absorbance as compared to that of the liquid soap alone. This is due to the fact that the untinted PET has a substantially uniform absorbance throughout the visible light spectrum, thus uniformly increasing the absorbance of the liquid soap and untinted PET combination as compared to the absorbance of the liquid soap alone. By selectively absorbing only the violet and blue wavelengths the liquid soap and untinted PET exhibit a yellow or yellow/green appearance similar to that of the liquid soap alone.

An absorbency measurement on the Hewlett-Packard spectrophotometer was also taken on a sample of deionized water and tinted PET. As can be seen from the plot of tinted PET in FIG. 3, the tinted PET preferentially absorbed wavelengths from about 530 nm to about 640 nm, yellow and green wavelengths. By selectively absorbing the yellow and green wavelengths the tinted PET exhibits a light blue or violet/blue appearance.

An absorbency measurement on the Hewlett-Packard spectrophotometer was also taken on a sample of liquid soap and tinted PET. As can be seen from the plot of the liquid soap and tinted PET in FIG. 3, the liquid soap and tinted PET combination absorbed wavelengths from about 470 nm to about 610 nm more uniformly than either the tinted PET or the liquid soap measured individually. By uniformly absorbing the wavelengths from about 470 nm to about 610 nm, the liquid soap and tinted PET combination exhibits a substantially colorless transparent appearance.

While particular embodiments of the present inventions have been illustrated and described, it will be obvious to those skilled in the art that various changes and modifications can be made without departing from the spirit and scope of the invention, and it is intended to cover in the appended claims all such modifications that are within the scope of this invention.

What is claimed is:

1. A filled package comprising:

(a) a substantially transparent container exhibiting the tint of a first color and being adapted to house a liquid; and (b) a substantially transparent liquid exhibiting the tint of a second color which is different than said first color and being housed in said container, the tint of said first color of said container and the tint of said second color of said liquid cooperating such that said tinted container when filled with said tinted liquid exhibits a substantially colorless transparent appearance.

2. The filled package according to claim 1 wherein said container preferentially absorbs wavelengths in the range from about 530 nm to about 630 nm.

3. The filled package according to claim 1 wherein said liquid preferentially absorbs wavelengths in the range from about 430 nm to about 530 nm.

4. The filled package according to claim 1 wherein said filled package absorbs wavelengths in the range from about 470 nm to about 610 nm substantially uniformly.

5. The filled package according to claim 1 wherein said liquid is a liquid soap.

6. The filled package according to claim 1 wherein said container is made of plastic.

7. The filled package according to claim 6 wherein the material comprising said container is selected from the group consisting of polyethylene terephthalate, glycol modified pet copolymer, extrudable polyethylene terephthalate, polyvinyl chloride, oriented polypropylene, polycarbonate, polystyrene or high density polyethylene.

8. A filled package comprising:

(a) a substantially transparent container exhibiting a substantially blue tint and being adapted to house a liquid; and (b) a substantially transparent liquid soap exhibiting a substantially yellow tint and being housed in said container, the blue tint of said container and the yellow tint of said liquid soap cooperating such that said tinted container when filled with said tinted liquid soap exhibits a substantially colorless transparent appearance.

9. The filled package according to claim 8 wherein said container preferentially absorbs wavelengths in the range from about 530 nm to about 630 nm.

10. The filled package according to claim 8 wherein said liquid preferentially absorbs wavelengths in the range from about 430 nm to about 530 nm.

11. The filled package according to claim 8 wherein said filled package absorbs wavelengths in the range from about 470 nm to about 610 nm substantially uniformly.

12. The filled package according to claim 8 wherein said container is made of plastic.

13. The filled package according to claim 12 wherein the material comprising said container is selected from the group consisting of polyethylene terephthalate, glycol modified pet copolymer, extrudable polyethylene terephthalate, polyvinyl chloride, oriented polypropylene, polycarbonate, polystyrene or high density polyethylene.

* * * * *